US005955166A

United States Patent [19]

Murphy

[11] Patent Number: 5,955,166

[45] Date of Patent: Sep. 21, 1999

[54] POINT OF PURCHASE LABEL CONSTRUCTIONS

[75] Inventor: Sharon M. Murphy, Bay Village, Ohio

[73] Assignee: Moore U.S.A., Inc., Grand Island, N.Y.

[21] Appl. No.: 08/865,063

[22] Filed: May 29, 1997

[51] Int. Cl.[6] ..... G09F 3/00

[52] U.S. Cl. ..... 428/40.1; 283/81; 283/111; 428/41.8; 428/42.1; 428/42.2; 428/43; 428/904.4

[58] Field of Search ..... 428/40.1, 41.8, 428/42.1, 42.2, 43, 904.4; 283/81, 111

[56] References Cited

U.S. PATENT DOCUMENTS

| | | | |
|---|---|---|---|
| 3,054,202 | 9/1962 | Scholfield | 40/23 |
| 3,924,744 | 12/1975 | Heimann | 206/460 |
| 4,127,690 | 11/1978 | Schleifenbaum et al. | 428/40.1 |
| 4,679,823 | 7/1987 | Nagy | 283/81 |
| 4,726,131 | 2/1988 | Cass | 283/81 |
| 4,940,258 | 7/1990 | Cuba, Jr. et al. | 283/81 |
| 5,016,370 | 5/1991 | Rhian et al. | 283/81 |
| 5,056,824 | 10/1991 | Olson | 283/81 |
| 5,227,209 | 7/1993 | Garland | 428/40.1 |
| 5,466,502 | 11/1995 | Wilkinson et al. | 283/81 |
| 5,509,694 | 4/1996 | Laurash et al. | 283/81 |
| 5,597,635 | 1/1997 | Pusl et al. | 283/81 |
| 5,601,313 | 2/1997 | Konkol et al. | 283/81 |

*Primary Examiner*—Nasser Ahmad
*Attorney, Agent, or Firm*—Nixon and Vanderhye

[57] ABSTRACT

A display assembly uses a particular point of purchase label construction associated with a point of purchase display construction associated with a displayed item for purchase that does not take up valuable area that is covered by price stickers, or the like, and in a manner that allows a retail establishment to save up to several hours a week in prominently displaying point of purchase messages. The label construction includes a label face stock having first and second faces, an opaque release liner stock also having first and second faces, the first face of the release liner ply having an adhesive release coating (such as silicone), and the second face of the release liner having first, point of purchase, indicia imaged thereon (such as "As Advertised"), and a pressure sensitive adhesive (preferably repositional) between the adhesive release coating the label face stock to releasably hold the plies together. A single line of weakness (such as a microperforation) is typically disposed in the release liner stock separating it into a first portion having the first indicia, and a second portion that is smaller than the first and readily removed to expose adhesive on a portion of the face stock second face. That exposed adhesive is pressed into contact with a surface of a point of purchase display (such as the back of a shelf surface) so that the point of purchase indicia is readily visible to one viewing an item displayed by the point of purchase display.

12 Claims, 4 Drawing Sheets

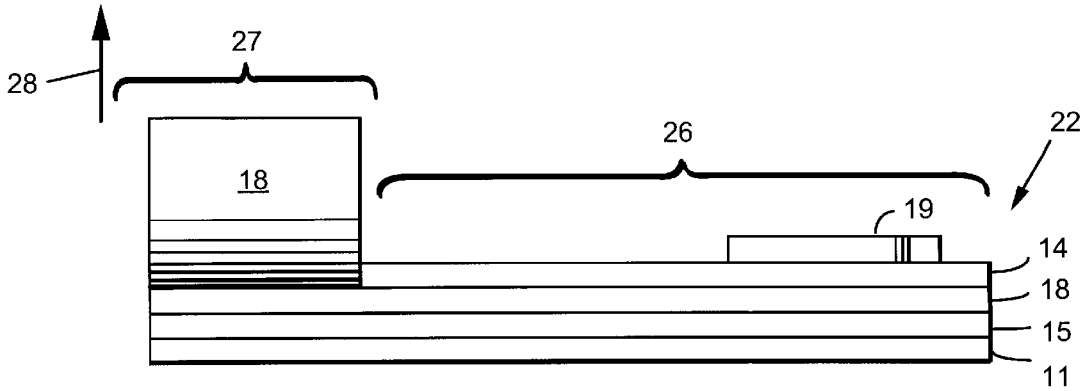
Fig. 3
Fig. 4
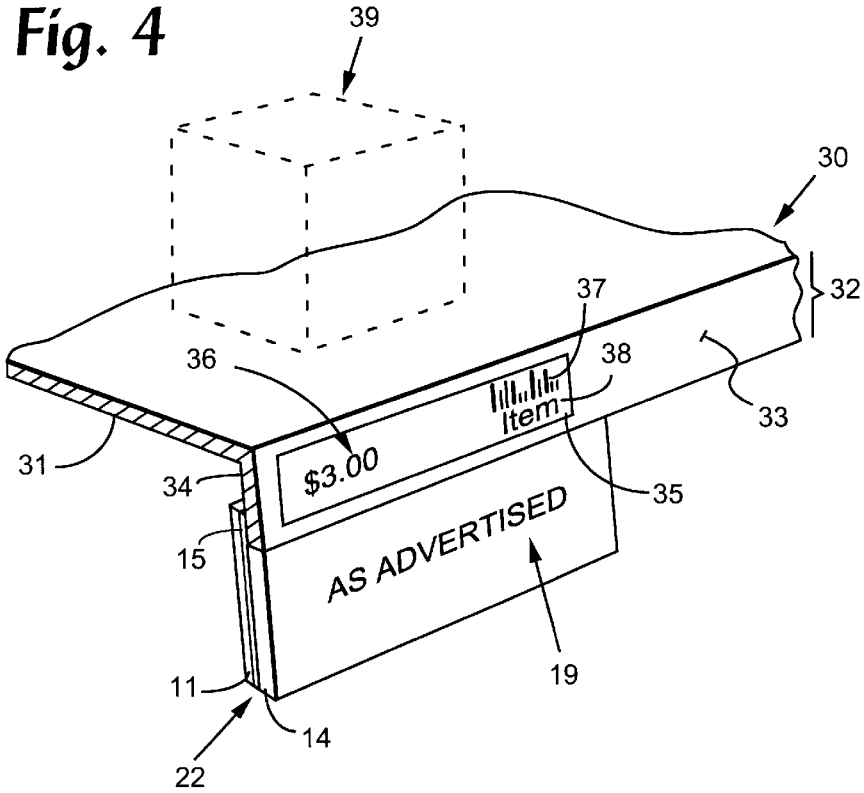

POINT OF PURCHASE LABEL CONSTRUCTIONS

BACKGROUND AND SUMMARY OF THE INVENTION

In point of purchase displays in retail establishments, common sales aids are used directly at the points of purchase that are referred to as "shelf talkers". Traditional shelf talkers are face printed pressure sensitive adhesive labels with the adhesive exposed on the back when the liner is removed. This allows it to stick face down, often covering something below it, and covers valuable point of purchase areas (such as shelf edges) that may be better used for other sales information. Other conventional shelf talkers include a wide variety of non-pressure sensitive tags, placed in clips or behind other tags. Traditional shelf talkers are used on shelves, on display pegs, or the like. One known type of conventional shelf talker is called a "shelf wrap" and comprises a tag that clips in and wraps around and behind pegs or other shelving.

In retail establishments where there is very limited shelf space and a wide variety of products to be displayed for retail sales, prior art shelf talkers take up valuable area that might better be used with price, quantity, or like indicia. Also some conventional shelf talkers are cumbersome and time consuming to put up and take down, and in retail establishments where there is a high volume of traffic or constantly changing advertised specials, price reductions, or the like, shelf talkers sometimes need to be put up and taken down daily or weekly. Conventional cut-to-size card stock shelf wrap in particular is very cumbersome and time consuming, gets hard to see, and gets bent or sticks out at eye level due to the multitude of shelving, pallet, and peg configurations that it is forced to fit. Spending time with such tags takes away from time that sales representatives could better be spending interfacing with customers, stocking shelves, or the like.

According to the present invention a point of purchase label construction, particularly utilizable in a display assembly, and in a method of associating point of purchase indicia with a point of purchase display, is provided which has significant advantages compared to the prior art techniques. The label constructions, or "shelf talkers", according to the present invention allow the adhesive to face forward of where the relevant indicia is, so that they may be applied behind a shelf or a peg. They also allow for several other unique folding capabilities for those facings that do not conform entirely to conventional practice. The label constructions according to the present invention provide a high gloss face which has an attractive appearance, can be bent to fit any facing, are easily detached, have great eye appeal and selling appeal, a professional look, and most significantly are easier to use and less costly and time consuming to install than conventional shelf talkers. As a matter of fact utilizing label constructions according to the present invention a typical high volume retail establishment could be expected to save about two man hours of labor per week while at the same time providing a more effective point of purchase environment. The label constructions according to the present invention are associated with the backs of vertical shelving or peg surfaces where they do not compete with price or other labels, tags, or the like for space, yet at least as effectively get the point of purchase message associated therewith across as if they were on the front of the shelf or peg surfaces. The label constructions according to the invention also can be used in association with a vertical wall of a display rack.

According to one aspect of the present invention a point of purchase label construction is provided comprising the following components: A label face stock ply having first and second faces. An opaque release liner stock ply having first and second faces, the first face of the release liner ply having an adhesive release coating, and the second face of the release liner ply having first, point of purchase, indicia imaged thereon. A pressure sensitive adhesive between the adhesive release coating and the label face stock ply second face, releasably holding the plies together. And, a single line of weakness disposed in the release liner stock ply and separating the release liner stock into a first portion having the first indicia imaged thereon, and a second portion smaller than the first portion, and allowing ready removal of the second portion from the face stock ply to expose the adhesive on a portion of the face stock ply second face.

Typically the face stock ply first face is devoid of point of purchase indicia (although it may include instructional indicia to the installer, reorder information, or the like). Also the release liner ply second face second portion typically has indicia imaged thereon, such as the word "remove", indicating removal of the second portion in order to utilize the construction. The face stock ply may be of synthetic material, such as polypropylene, and the adhesive is preferably repositional adhesive, such as CLEANTAC™ adhesive used with repositional products of Moore U.S.A., Inc. of Lake Forest, Ill., or the adhesive used in the 3M POST-IT® products. The release liner ply may be bond paper, and the adhesive release coating a conventional silicone coating. The release liner ply typically has a fairly large weight so that it lays flatter during use, for example a weight of between about 85–100 (e.g. about 92) lbs. per 24×36 inch 500 sheet ream.

The label construction according to the present invention typically is supplied in an integral combination with a plurality of other label constructions in an 8½×11 inch sheet, the label constructions separated from each other in the sheet by lines of weakness, such as conventional microperforations. For example between 12–20 label constructions (typically 15 or 18) are provided in a sheet. The sheet may also have removable marginal portions containing instructional indicia on the release liner ply second face, telling how to use the label constructions. Typically the label constructions have a quadrate configuration with width and length dimensions of roughly between 1.25–1.5 inches× 2.75–3.5 inches, respectively.

According to another aspect of the present invention a display assembly is provided comprising the following components: A point of purchase label construction, comprising: A label face stock ply having first and second faces; an opaque release liner stock ply having first and second faces, the first face of the release liner ply having an adhesive release coating, and the second face of the release liner ply having first, point of purchase, indicia imaged thereon; a pressure sensitive adhesive between the adhesive release coating and the label face stock ply second face, releasably holding the plies together; and the face stock ply being larger than the release liner ply so that a portion of the adhesive is exposed on the face stock ply second face. A point of purchase display construction having a surface, and associated with a displayed item for purchase. And, the exposed adhesive in contact with the surface of the point of purchase display so that the point of purchase indicia is readily visible to one viewing an item displayed by the point of purchase display.

The point of purchase display construction may comprise a shelf, and the surface may comprise a back face of a vertical portion of the shelf, the shelf vertical portion also having a front face on which item price information indicia is displayed. The exposed adhesive may be in contact with the back face of the shelf vertical portion so that the label construction point of purchase indicia is viewable at the same time as the item price information indicia. Preferably the adhesive is repositional so that the label construction may be readily removed from contact with the shelf surface and positioned in another location. The release liner ply may have a quadrate construction with width and length dimensions of roughly 1¼ inches×3½ inches, respectively, and the exposed adhesive area of the face stock ply may also have a quadrate construction with width and length dimensions of roughly 0.8 cm×3½ inches.

Alternatively the point of purchase construction may comprise a peg having a price tag, with the surface remote from the peg price tag, such as back portion of the peg. As yet another alternative the point of purchase display construction may comprise a rack, and the surface a substantially vertical wall of the rack. In that case the face stock ply of the label construction is bent over so that the release liner ply second face is disposed about 180° from the exposed adhesive portion of the face stock ply second face.

According to yet another aspect of the present invention a method of associating point of purchase indicia with a point of purchase display construction having a surface, and associated with a displayed item for purchase, is provided. The method utilizes a point of purchase label construction such as described above. The method comprises the steps of: (a) Separating the release liner ply at the line of weakness to expose the adhesive on a portion of the face stock ply second face. And, (b) pressing the exposed adhesive into contact with the surface of the point of purchase display construction so that the point of purchase indicia on the release liner second face is readily visible at the same time that the display item is viewed.

Where the point of purchase display construction comprises a shelf and the surface is a back face of a vertical portion of the shelf, step (b) is practiced by pressing the exposed adhesive into contact with the back face of the shelf vertical portion so that the label construction point of purchase indicia is viewable at the same time as the item price information indicia on the front face of the shelf vertical portion.

When the point of purchase display construction comprises a peg having a displayed item price tag, and the surface is remote from the peg price tag, step (b) is practiced by pressing the exposed adhesive into contact with the peg so that the label construction point of purchase indicia is viewable at the same time as the displayed item price tag.

Alternatively where the point of purchase display construction comprises a rack, and wherein the surface is a substantially vertical wall of the rack, step (b) is practiced by bending over the face stock ply of the label construction so that the release liner ply second face is disposed about 180° from the exposed adhesive portion of the face stock ply second face.

It is the primary object of the present invention to provide an advantageous point of purchase label construction, that may be used in an advantageous display assembly and a method of associating point of purchase indicia with a display construction. This and other objects of the invention will become clear from an inspection of the detailed description of the invention, and from the appended claims.

BRIEF DESCRIPTION OF THE DRAWINGS

FIG. 3 is a side schematic view, with the components greatly enlarged in thickness for clarity of illustration, of the detached label construction of FIG. 2;

FIG. 4 is a top perspective schematic view of the detached label construction of FIGS. 2 and 3 shown in association with a shelf having a display item thereon;

DETAILED DESCRIPTION OF THE DRAWINGS

Figure 1:
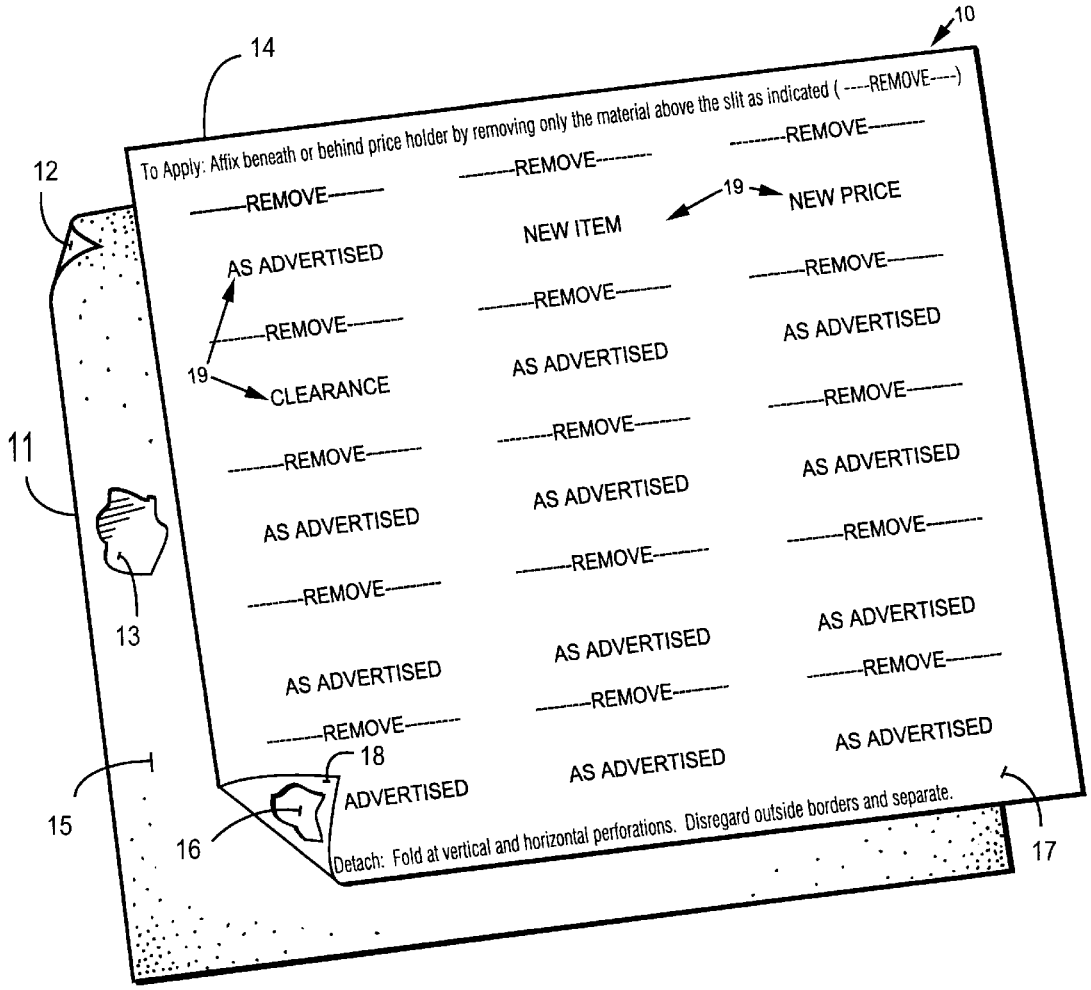
FIG. 1 is a top perspective exploded view of a sheet of point of purchase label constructions according to the present invention, prior to formation of lines of weakness therein.

A sheet of label constructions, prior to introduction of lines of weakness therein to separate the sheet into individual label constructions, according to the present invention is illustrated schematically at 10 in FIG. 1. It includes a label face stock ply 11, having a first face 12 and a second face 13. The face stock ply 11 preferably is of polyethylene or like synthetic material, although it may be a bond paper. Disposed on the face 13, either from transfer from the opaque release liner stock 14 ply, or applied directly thereto, is a pressure sensitive adhesive shown schematically at 15. The pressure sensitive adhesive 15 may be permanent or removable adhesive of conventional type, but preferably is a conventional repositional adhesive, such as CLEANTAC™ adhesive used with CLEANTAC® labels and other products available from Moore U.S.A., Inc. of Lake Forest, Ill., or the type of repositional adhesive used in POST-IT® products available from 3-M of Minneapolis, Minn.

The release liner ply 14 has a first face 16 and a second face 17, the first face 16 having an adhesive release coating—shown schematically at 18 in FIG. 1—thereon. Any conventional adhesive release coating which will readily release from the adhesive 15 may be provided, such as a conventional silicone coating.

The second face 17 of the release liner stock ply 14 has point of purchase indicia 19 imaged thereon. For example this could be "as advertised", "new item", "new price", "clearance", "less than $2", or a wide variety of other types of point of purchase messages aside from pure price or item information. The indicia 19 may be imaged on the face 17 in any conventional manner using any conventional impact, electrostatic, or like imaging technique. The face 17 may be made glossy, as by providing a glossy coating like varnish. The release liner stock ply 14 may be made of any suitable material, but one particularly desirable material is bond cellulose paper having a weight of about 85–100 (e.g. about 92) lbs. per 24×36 inch 500 sheet ream. With that relatively heavy weight, the composite construction 10 may be expected to lay flat during use, which is highly desirable.

Typically the base stock ply first face 12 is devoid of point of purchase indicia since it is only the indicia 19 that will be viewed by a potential consumer in normal circumstances and environments. However the face 12 may be provided with instructional, reorder, or like indicia, that is not designed to be seen during normal use of the constructions 10.

Typically the plies 11, 14 are releasably held together by the adhesive 15. The plies 11, 14 include lines of weakness therein. The sheet 10 preferably has dimensions of about 8½×11 inches (although it may be of other conventional readily usable sizes, such as legal size or A4) with the individual label constructions (22) separated by lines of weakness, and a single line of weakness provided in each label construction. For example see FIG. 2 which shows the plies 11, 14 held together by the adhesive 15, and shows major lines of weakness 21 dividing the sheet 10 into individual label constructions 22, and within each label construction 22 is a single line of weakness 23. Also perimeter lines of weakness 24 may be provided for dividing the label constructions 22 from marginal portions of the sheet 10 which have instructional indicia 25 therein. All of the lines of weakness 21, 23, 24 may be conventional lines of weakness such as perforations, die cuts or the like, but preferably are conventional microperforations.

The lines of weakness 21, 24 extend in both plies 11, 14, while the lines of weakness 23 are merely provided in the release liner ply 14.

Figure 2:
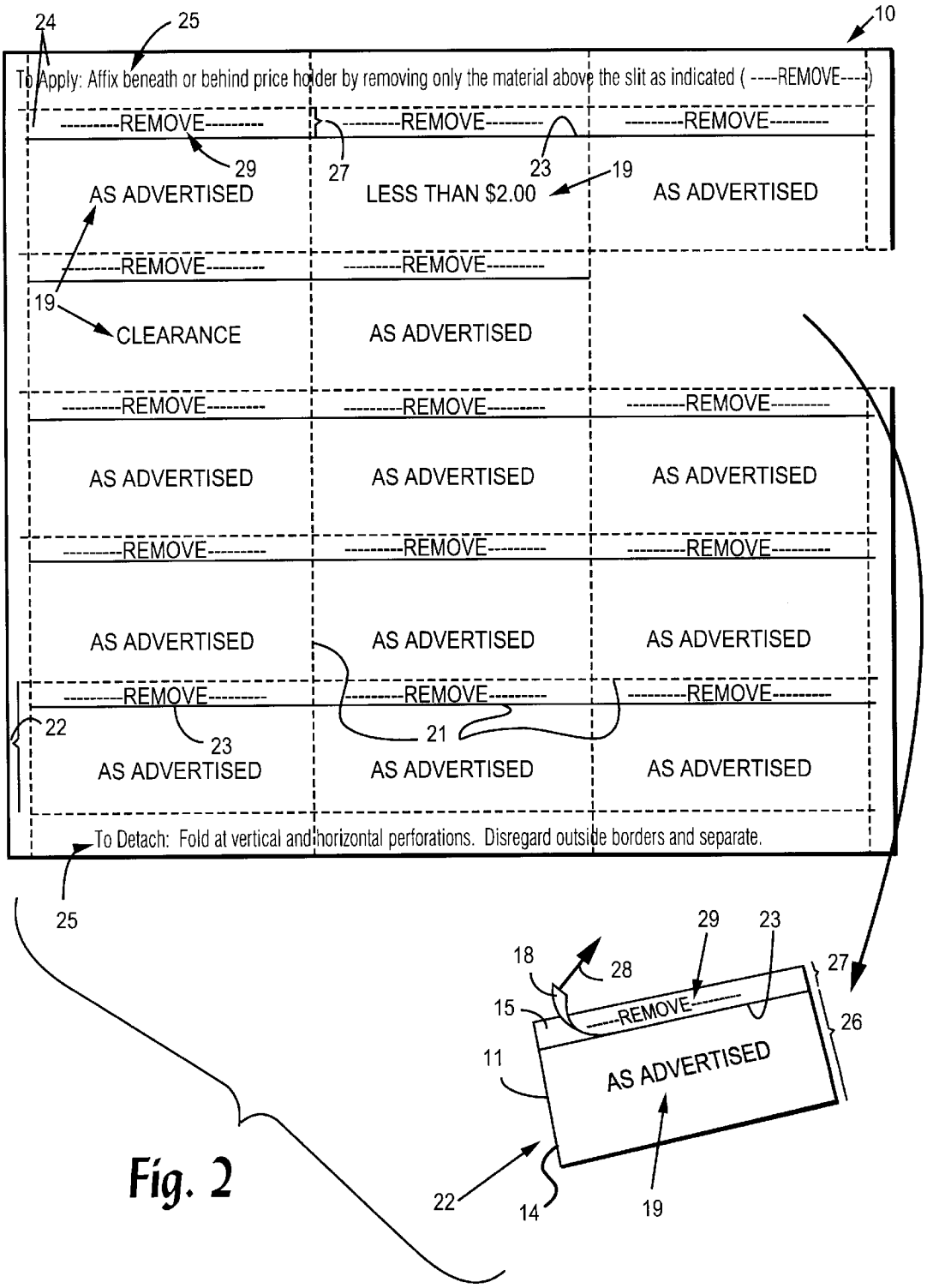
FIG. 2 is a top plan view of the finally constructed sheet of FIG. 1, with one of the label constructions being shown detached therefrom and in perspective.

The single line of weakness 23 associated with each label construction 22 is provided in the release liner stock 14 and separates the release liner stock into a first portion 26 (see label construction 22 in FIG. 2) having the first indicia 19 imaged thereon, and a second portion 27, smaller than the first portion 26. The line of weakness 23 allows ready removal of the portion 27 from the ply 11 to expose the adhesive 15 underlying the portion 27 on the face stock ply 11 second face 13. FIG. 2 illustrates the portion 27 being removed as indicated by the arrow 28. The portion 27 may have indicia 29 imaged thereon such as the word "remove" as illustrated in FIG. 2—indicating removal of the second portion 27.

While the label constructions 22 may have a wide variety of sizes, typically—as illustrated in FIG. 2—between 12–20 label constructions 22 are provided in an 8½×11 inch sheet 10 (typically 15 or 18). In this way each label construction 22 has a quadrate configuration with width and length dimensions of roughly 1.25–1.5 inches×2.75–3.5 inches, respectively.

FIG. 3 schematically shows a label construction 22 with a thickness of the various components greatly exaggerated in size for clarity of illustration. Note that when the release liner portion 27 is removed, as by pulling in the direction of arrow 28, the pressure sensitive adhesive 15 remains on the second face 13 of the face stock ply 11, with that portion below the removed section 27 exposed for pressing into contact with an appropriate surface.

FIG. 4 illustrates one embodiment of a display assembly, shown generally by reference numeral 30, according to the present invention in which the label construction 22 is seen in actual use with a point of purchase display construction, in this case a shelf 31 having a vertical portion 32 (e.g. downwardly extending) having a front face 33 and a back face 34. The front face 33 typically has price, item, and like information displayed thereon, such as a conventional tag or label 35 having price indicia 36, machine readable indicia 37, and item indicia 38 thereon. The display construction 30 is associated with a display item, shown in dotted line schematically at 39 in FIG. 4, available for purchase. The item 39 can be any item that the retail store sells in any type of packaging.

The label construction 22 is used in the display assembly 30 so that the exposed adhesive 15 which was covered by the removed release liner portion 27 (see FIGS. 2 and 3) is pressed into contact with the back face 34 of the shelf vertical portion 32. This means that the label construction point of purchase indicia 19 is visible at the same time as the item price information indicia 36, and other indicia 37, 38, as seen in FIG. 4. Thus without taking up any part of the front face 33 of the shelf vertical portion 32, the label construction 22 according to the invention delivers an effective point of purchase message with significant eye appeal and selling appeal, and a professional look, and is easy and inexpensive to apply and remove.

Thus in the utilization of the label construction 22 in the display assembly 30, first a label construction 22 from a sheet 10 is detached at the lines of weakness 21 (and in some cases 24 too), the release liner portion 27 is removed by pulling in the direction of arrow 28 to expose the adhesive 15 underlying it, and that adhesive 15 section is then pressed into contact with the back face 34 of the shelf vertical portion 32, resulting in the point of purchase display assembly as illustrated in FIG. 4.

Figure 5:
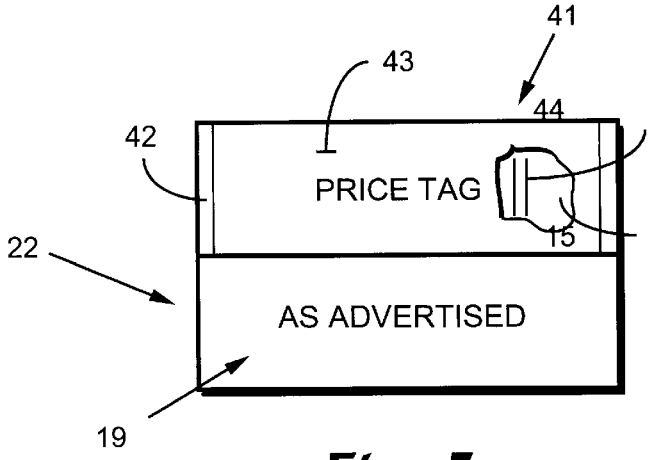
FIG. 5 is a front schematic view of the label construction of FIGS. 2 and 3 shown associated with a peg having a price tag.

FIG. 5 is a schematic illustration of another exemplary display assembly according to the invention. In this case the display assembly 41 comprises a conventional peg, shown only schematically at 42, with a conventional price tag 43 or the like associated therewith and a surface 44 remote from the price tag 43. The exposed adhesive 15 on the portion of the face stock that underlain the portion 27 of the face liner is brought into contact with the surface 44 so that the indicia 19 and the price tag 43 indicia are visible at the same time to a potential customer.

Figure 6:
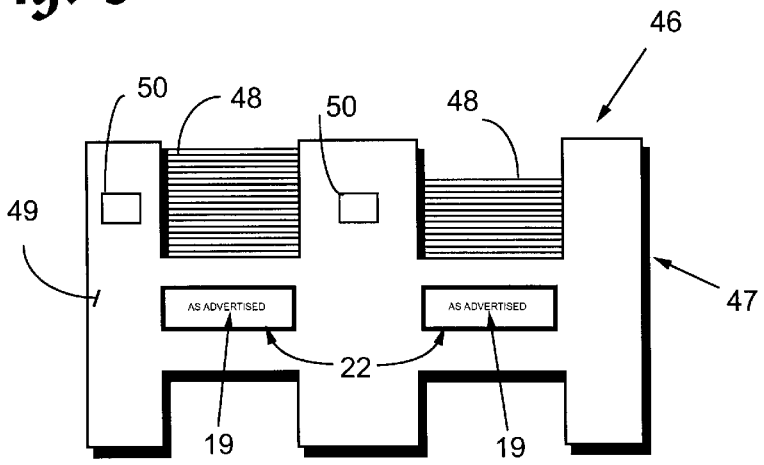
FIG. 6 is a front schematic view of a detached label construction according to FIGS. 2 and 3 shown in association with a display rack.
Figure 7:
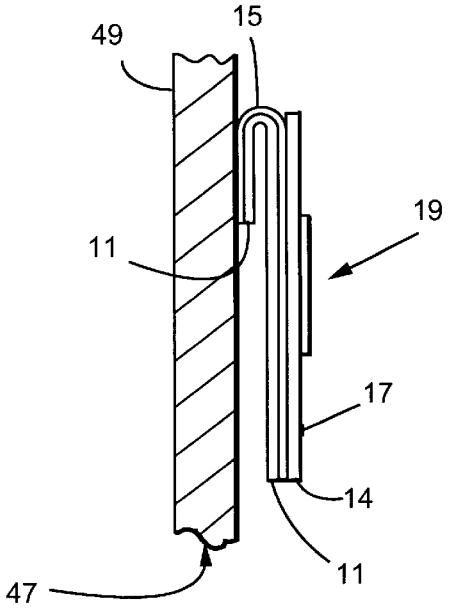
FIG. 7 is a detail side view of the label construction as used in FIG. 6.

FIGS. 6 and 7 illustrate yet another embodiment of the display assembly according to the present invention, in this case illustrated schematically by reference numeral 46. In this embodiment the display construction 46 comprises a rack 47, which displays items 48 for purchase, such as CDs, magazines, or a wide variety of other products. The rack 47 has a substantially vertical wall portion 49, which may comprise a front wall, and which may have price and other information tags or labels 50 or the like mounted thereon, as well as one or more label constructions 22 according to the present invention. FIG. 7 illustrates how the label constructions 22 are applied in this embodiment, with the ply 11 bent over so that the release liner ply 14 second face 17 is disposed about 180° from the exposed adhesive 15 of the face stock ply 11 second face 13, the exposed adhesive 15 in contact with the surface 49 of the rack 47.

Utilizing the label constructions 22 according to the present invention many retail establishments can save as much as two man hours per week in employee time in installing and removing "shelf talkers", while enhancing the delivery of point of purchase messages.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent constructions, assemblies, and methods.

What is claimed is:

1. A display assembly, comprising:

a point of purchase label construction, comprising: a label face stock ply having first and second faces; an opaque release liner stock ply having first and second faces, said first face of said release liner ply having an adhesive release coating, and said second face of said release liner ply having first, point of purchase, indicia imaged thereon; a pressure sensitive adhesive between said adhesive release coating and said label face stock ply second face, releasably holding said plies together; and said face stock ply being larger than said release liner ply so that a portion of said adhesive is exposed on said face stock ply second face;

a point of purchase display construction having a surface, and associated with a displayed item for purchase; and said exposed adhesive in contact with said surface of said point of purchase display so that said point of purchase indicia is readily visible to one viewing an item displayed by said point of purchase display; and wherein said point of purchase display construction comprises a shelf, wherein said surface comprises a back face of a vertical portion of said shelf, and wherein said shelf vertical portion also has a front face on which item price information indicia is displayed; and wherein said exposed adhesive is in contact with said back face of said shelf vertical portion so that said label construction point of purchase indicia is viewable at the same time as said item price information indicia.

2. An assembly as recited in claim 1 wherein said adhesive is repositional so that said label construction may be readily removed from contact with said shelf surface and positioned in another location.

3. An assembly as recited in claim 2 wherein said release liner ply has a quadrate construction with width and length dimensions of roughly 1–1¼ inches by 3½ inches, respectively, and said exposed adhesive area of said face stock ply also has a quadrate construction with width and length dimensions of roughly 0.8 cm by 3½ inches.

4. An assembly as recited in claim 3 wherein said adhesive is repositional so that said label construction may be readily removed from contact with said surface and positioned in another location.

5. A display assembly, comprising:

a point of purchase label construction, comprising: a label face stock ply having first and second faces; an opaque release liner stock ply having first and second faces, said first face of said release liner ply having an adhesive release coating, and said second face of said release liner ply having first, point of purchase, indicia imaged thereon; a pressure sensitive adhesive between said adhesive release coating and said label face stock ply second face, releasably holding said plies together; and said face stock ply being larger than said release liner ply so that a portion of said adhesive is exposed on said face stock ply second face;

a point of purchase display construction having a surface, and associated with a displayed item for purchase;

said exposed adhesive in contact with said surface of said point of purchase display so that said point of purchase indicia is readily visible to one viewing an item displayed by said point of purchase display; and wherein said point of purchase display construction comprises a peg having a price tag, and wherein said surface is remote from said peg price tag.

6. A display assembly, comprising:

a point of purchase label construction, comprising: a label face stock ply having first and second faces; an opaque release liner stock ply having first and second faces, said first face of said release liner ply having an adhesive release coating, and said second face of said release liner ply having first, point of purchase, indicia imaged thereon; a pressure sensitive adhesive between said adhesive release coating and said label face stock ply second face, releasably holding said plies together; and said face stock ply being larger than said release liner ply so that a portion of said adhesive is exposed on said face stock ply second face;

a point of purchase display construction having a surface, and associated with a displayed item for purchase;

said exposed adhesive in contact with said surface of said point of purchase display so that said point of purchase indicia is readily visible to one viewing an item displayed by said point of purchase display; and wherein said point of purchase display construction comprises a rack, and wherein said surface is a substantially vertical wall of said rack, and wherein face stock ply of said label construction is bent over so that said release liner ply second face is disposed about 180° from said exposed adhesive portion of said face stock ply second face.

7. An assembly as recited in claim 5 wherein said adhesive is repositional so that said label construction may be readily removed from contact with said surface and positioned in another location.

8. An assembly as recited in claim 5 wherein said release liner ply has a quadrate construction with width and length dimensions of roughly 1–1¼ inches by 3½ inches, respectively, and said exposed adhesive area of said face stock ply also has a quadrate construction with width and length dimensions of roughly 0.8 cm by 3½ inches.

9. An assembly as recited in claim 8 wherein said adhesive is repositional so that said label construction may be readily removed from contact with said surface and positioned in another location.

10. An assembly as recited in claim 6 wherein said adhesive is repositional so that said label construction may be readily removed from contact with said surface and positioned in another location.

11. An assembly as recited in claim 6 wherein said release liner ply has a quadrate construction with width and length dimensions of roughly 1–1¼ inches by 3½ inches, respectively, and said exposed adhesive area of said face stock ply also has a quadrate construction with width and length dimensions of roughly 0.8 cm by 3½ inches.

12. An assembly as recited in claim 11 wherein said adhesive is repositional so that said label construction may be readily removed from contact with said surface and positioned in another location.

* * * * *